US006071203A

United States Patent [19]

Janes et al.

[11] Patent Number: 6,071,203

[45] Date of Patent: Jun. 6, 2000

[54] TWO PIECE SPORTS RACQUET

[75] Inventors: Richard Janes, Burlington Township, N.J.; Stephen J. Davis, Washington Crossing; Brian J. Blonski, Yardley, both of Pa.

[73] Assignee: Prince Sports Group, Inc., Bordentown, N.J.

[21] Appl. No.: 09/133,629

[22] Filed: Aug. 13, 1998

[51] Int. Cl.[7] ..... A63B 49/02

[52] U.S. Cl. ..... 473/535; 473/536; 473/540

[58] Field of Search ..... 473/524, 531, 473/535, 536, 539, 540, 541, 542

[56] References Cited

U.S. PATENT DOCUMENTS

| | | | |
|---|---|---|---|
| 4,333,649 | 6/1982 | Vaughn et al. | 473/540 |
| 4,783,362 | 11/1988 | Thornton et al. | 442/203 |
| 5,014,987 | 5/1991 | Soong | 473/539 X |
| 5,052,906 | 10/1991 | Seemann | 425/112 |
| 5,551,689 | 9/1996 | Svoma et al. | 473/535 |

FOREIGN PATENT DOCUMENTS

| | | | |
|---|---|---|---|
| 3408175 | 9/1985 | Germany | 473/FOR 177 |
| 3501956 | 8/1986 | Germany | 473/FOR 177 |
| 3817464 | 11/1989 | Germany | 473/FOR 177 |

*Primary Examiner*—Raleigh W. Chiu
*Attorney, Agent, or Firm*—Skadden, Arps, Slate, Meagher & Flom

[57] ABSTRACT

A composite sports racquet includes a head portion which is formed by an upper frame half and a lower frame half. Each frame half is a tubular frame section, and includes a generally flat wall. The two walls are bonded to one another to form a unitary head portion, whereby the first and second walls form internal frame ribs oriented generally parallel to the string bed plane and extending continuously around the head portion. The upper and lower frame halves are preferably pre-molded individually and thereafter glued to one another. Alternatively, one of the frame halves can be pre-molded, with the other frame half thereafter molded onto the pre-molded half Preferably, the first and second walls include a plurality of channel portions which, when the racquet halves are joined, define the string holes. Preferably, the channel portions are contoured at the outer frame surface to form curved bearing surfaces for string entry. Also, if desired, the string holes can be molded so as to extend parallel to the string ends, rather than perpendicular to the racquet frame as is generally done with drilled string holes. Preferably, the string holes have a dimension, in a direction perpendicular to the string bed plane, which is substantially greater than the diameter of standard racquet strings, so that the strings are supported only on the outer portion of the frame, thereby extending the effective string length.

29 Claims, 16 Drawing Sheets

TWO PIECE SPORTS RACQUET

FIELD OF INVENTION

The present invention relates to sports racquets such as tennis racquets, squash racquets, badminton racquets, and racquetball racquets, which have hollow tubular frames made of composite materials such as "graphite".

BACKGROUND OF THE INVENTION

High performance sports racquets have a hollow tubular wall made of graphite material. To make such racquets, an elongated tube of pre-preg, formed of uncured graphite, is placed in a mold in the desired shape of the racquet frame. A bladder placed inside the pre-preg tube is inflated, such that the pre-preg assumes the shape of the mold, and the mold is heated to cure the epoxy resin and harden the frame.

After the frame is made, holes are drilled through the opposing walls of the tubular frame to support the ends of the racquet strings. If left uncovered, the sharp edges of the string holes would cause serious string breakage problems. For such reason, composite sports racquets employ plastic grommet strips to prevent direct contact between the strings and the holes in the frame. The grommet strips ride in a stringing groove formed along the outside surface of the racquet head portion, and contain a plurality of hollow grommet pegs, which extend through the holes in the frame. When the racquet is thereafter strung, the strings exit through the hollow barrels of the grommet pegs, and bear against the grommet strip along the outside of the racquet until reaching the next string hole, in this manner avoiding direct contact with the graphite frame.

Prior to Howard Head U.S. Pat. No. 3,999,756, tennis racquets had a relatively small head. When the original grommets were conceived, problems of excess weight did not exist because heavier frame weights were acceptable with smaller head sizes. The '756 patent discloses increasing the relative length and width of the head without increasing the overall racquet size, and today virtually all adult tennis racquets are made utilizing such racquet geometry. However, with the increased head size, the additional weight of the grommet strips and bumper strips became a recognized problem.

Over the years, newer, stiffer frame materials, together with advances in molding techniques, have allowed composite sports racquets to become increasingly light. Today's graphite tubular frames as molded are very strong and very stiff, even with very thin wall thicknesses. However, when racquet string holes are subsequently drilled in the racquet, carbon fibers are broken and the frame is weakened locally. This problem is exacerbated by the fact that the string holes must have a diameter large enough not just for a string, but for a plastic grommet peg. As frame walls have become increasingly thin, the process of drilling the string holes can weaken the frame significantly, to the point where the frame is unable to support the high forces of the tensioned strings, resulting in strings pulling through the walls of the frame tube.

Frame tubes also can fail after impact with a hard surface, such as the court surface, because such impact can produce cracks. For such reason, it is customary to provide grommet strips, in the outer region of the frame, with a pair of flanges covering the frame surface (such grommet strips being known as "bumper strips"), to help protect the frame from such impacts. These flanges add additional weight at the tip region, which is undesirable. Moreover, as tube walls have become thinner, they are more prone to impact damage, even with a bumper strip present.

SUMMARY OF THE INVENTION

A composite sports racquet according to the invention includes a head portion which is formed by an upper frame half and a lower frame half. Each frame half is a tubular frame section, and includes a generally flat wall parallel to the string bed plane. The two walls are bonded to one another to form a unitary head portion, whereby the first and second walls form internal frame ribs oriented generally parallel to the string bed plane and extending continuously around the head portion.

The upper and lower frame halves are preferably pre-molded individually and thereafter glued to one another using a suitable adhesive. Alternatively, one of the frame halves can be pre-molded, with the other frame half thereafter molded onto the pre-molded half by co-curing. A plurality of retractable pins can be inserted into the mold, between the precured and co-cured racquet halves, to form the string holes.

Preferably, the first and second walls include a plurality of channel portions, each defining half of a string hole such that, when the racquet halves are joined, the channel portions form the internal walls of complete string holes. Preferably also, the channel portions are given a smooth radii, i.e., are contoured, at the outer frame surface to form curved bearing surfaces for string entry. In such a manner, the strings do not contact any sharp surfaces on the frame. With the frame of the present invention, grommet strips need not be used due to the fact that the hole entrances are contoured. Alternatively, if a grommet strip is desired, the thickness can be reduced, and a softer material can be employed, due to the fact that there are no sharp edges where the strings enter and leave the string holes through the outside wall of the frame.

Moreover, even if grommet strips are used, it is not necessary to provide grommet pegs that extend through the frame. In conventional racquets, the strings extend through two aligned holes, formed in the outside and inside frame walls, respectively. Grommet pegs extend completely through the frame in order to protect the string not only from the sharp edges of the string hole in the outside frame wall but also from the sharp edges of the string hole in the inside frame wall. In contrast, in the present invention, the molded holes form a smooth, protective wall extending entirely through the frame.

Alternatively, if grommet pegs are desired, e.g., slotted grommets for damping string vibration, as disclosed in commonly owned U.S. Pat. No. 08/772,441, thinner grommet barrels, or barrels of softer material, can be employed, because such barrels do not need to perform a protecting function. This again allows the size of the holes through the racquet frame itself to be reduced.

The lighter weight or lower density plastics will thereby reduce grommet weight compared to conventional racquets, where relatively thick grommets of hard plastic are required to protect the strings adequately.

In conventional racquets, for practical purposes, the string holes need to be drilled at right angles to the tangent of the frame. Because the string holes of the present invention are molded rather than drilled, they may be molded so as to extend in the same direction as the string ends. In this embodiment, string holes for the main strings extend parallel to the racquet axis, and string holes for the cross-strings extend perpendicular to the axis. In addition, preferably the string holes have a dimension, in a direction perpendicular to the string bed plane, which is substantially greater than the diameter of standard racquet strings, so that the strings are supported only at the outer portion of the frame. Due to the use of string holes which run parallel to the string direction, all of the strings are anchored only at the outside wall of the frame, and their effective length is increased for greater power.

In one embodiment, one frame half has a plurality of projections extending from adjacent the planar wall surfaces towards the other frame half, and the other frame half has a plurality of mating recesses. The projections are in the form of peripheral ridges extending from the outer peripheral edges of the planar wall surfaces of the one frame half. The ridges include outer peripheral surfaces forming part of each string hole. The recesses are preferably bevel shaped surfaces formed in the outer peripheral edges of the planar wall surfaces of the other frame half. The ridges include mating bevel shape internal surfaces which are bonded to the bevel shaped surfaces of the recesses. In this embodiment, in which the racquet halves are not symmetrical, the strings bear against the outer surface of the ridges, rather than against the seam between racquet halves.

Molding, rather than drilling, the string holes, and providing an internal rib that is coextensive with the two racquet halves and parallel to the string bed, i.e., parallel to the direction of the string forces, produces a unified frame which is resistant to torsional forces, resistant to failure due to impact with the ground, and resistant to string pull-through due to string loading forces. Also, the molded string holes add significant rigidity to the dual internal ribs created by the adjoining walls of the two frame halves. Moreover, additional strength over conventional racquets results because no reinforcement fibers in the composite frame are broken in order to form the string holes, as occurs when string holes are drilled. Also, the string holes can be given a size which is substantially smaller than conventional string holes through the frame, e.g., 1.6–2.8 mm with no grommet strip, and 2.8–4.0 mm with a grommet strip, as opposed to a conventional frame hole size of 4.0–4.5 mm.

Because of this structural reinforcement of the internal ribs and smaller hole size, the two frame halves may have extremely thin wall thicknesses, e.g., as small as 0.5 mm. Thus, the two halves can be molded with a wall thickness such that, when the two halves are joined, the frame will have an overall weight which is less than a conventional graphite racquet made with a single hollow tube, and yet the racquet will have strength comparable to the heavier, conventional racquet. Alternatively, the racquet frame halves can be molded to have an overall weight comparable to a conventional racquet frame, in which case the racquet according to the invention will have greater strength. And, although such frame will have a weight comparable to a conventional racquet frame, when strung, the racquet according to the invention will weigh less, due to the elimination of the grommet strips or, at least, the grommet pegs. Alternatively, the weight saved by eliminating the grommet strips or pegs can be used to provide additional frame material for selective reinforcement of the frame.

In a racquet according to the present invention, the depth of the string groove can be reduced, compared with conventional racquets, due to the elimination of, or at least reduction in the thickness of, the grommet strips. In the case where the strings are supported only at the outside wall of the frame, reducing the string groove depth has the effect of increasing the spacing between the opposite string ends, thereby increasing the effective string length and increasing power.

If desired, some of the string holes may be formed to provide, on the outside of the frame, a curved, wrap-around bearing surface for reversing the direction of the string. Such a wrap-around bearing surface is particularly desirable where the throat bridge joins the main frame tube, to provide a smooth turnaround for the string. Such wrap-around bearing surfaces, however, also are desirable because they allow the main strings to be tensioned from the tip end of the frame, two-at-a-time, and thus it may be desirable to use such string holes for the lower ends of some or all of the other main strings or for some or all of the cross-strings.

As an alternative to molding the string holes, the string holes can be drilled through the frame after the two halves are joined. This embodiment, while lacking the advantages of molded-in string holes, still provides considerable advantages over conventional composite racquet frames and can be made with a simpler mold. As in the prior embodiments, the wall thickness of the composite material can be made thinner, due to the strengthening effects of the internal ribs, thereby decreasing racquet weight. Additional weight savings can be realized by decreasing the cross-sectional height (in a direction perpendicular to the string bed), thereby reducing the amount of frame material needed. Due to the internal ribs, this weight savings can be realized without sacrificing in-plane stiffness or strength.

Preferably, in this embodiment, the string holes are drilled alternately through the upper and lower frame halves so as to lie alternately on opposite sides of said internal frame ribs. In this manner; when the strings extend along the outer surface of the frame between string holes, they will cross over the internal ribs, which thereby reinforce the frame against the force applied by the string tension.

For a better understanding of the invention, reference is made to the following detailed description of a preferred embodiment, taken in conjunction with the drawings accompanying the application.

DETAILED DESCRIPTION OF PREFERRED EMBODIMENTS

Figure 1:
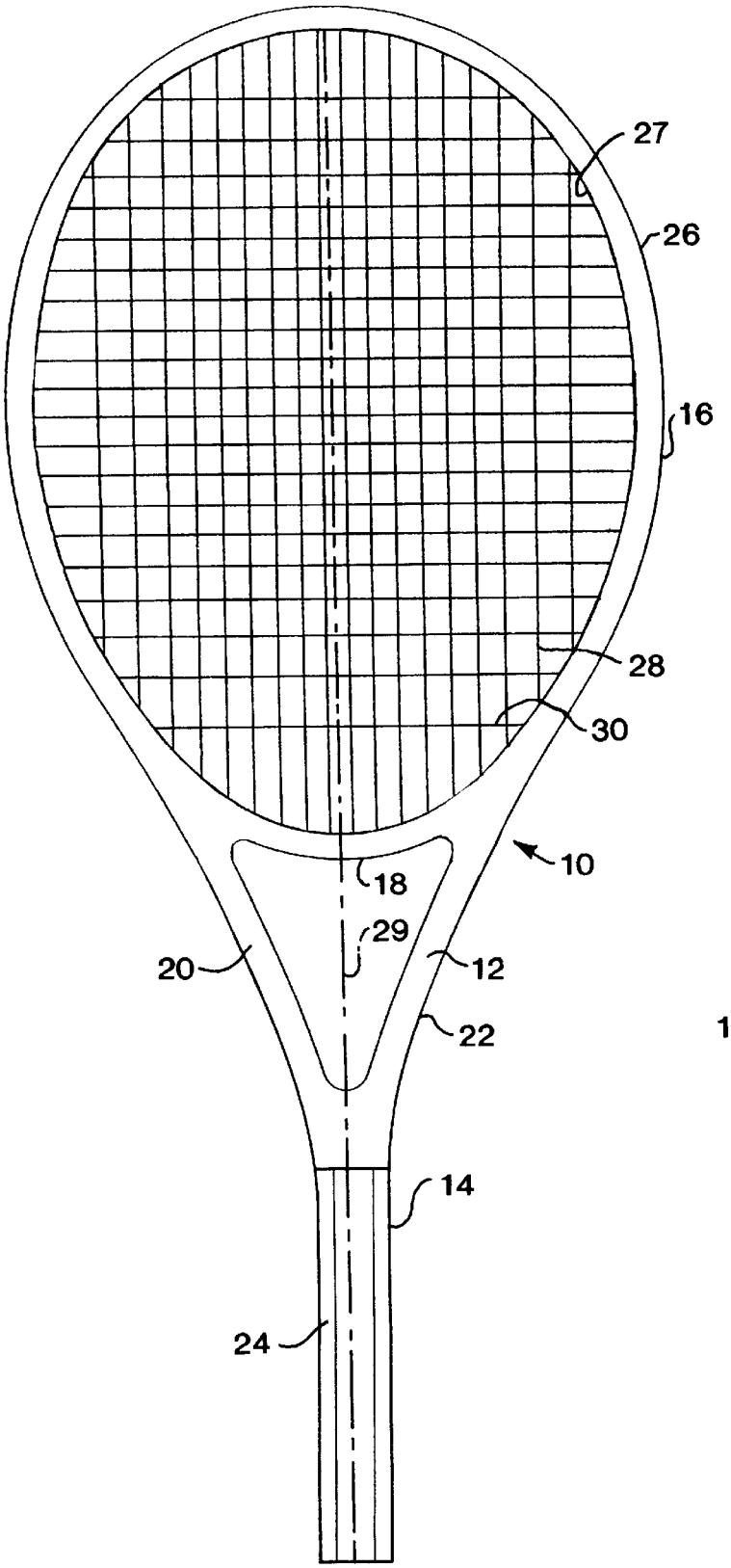
FIGS. 1 and 2 are front and side views, respectively, of a tennis racquet according to the invention.
Figure 2:
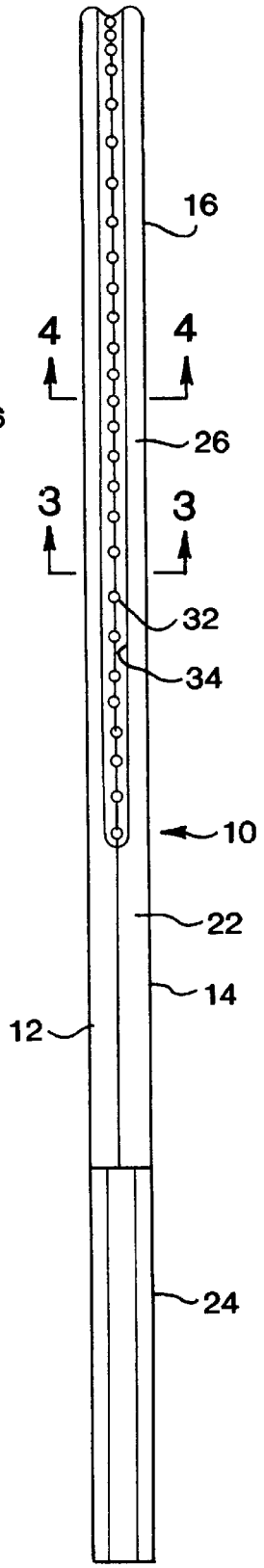
Figure 3:
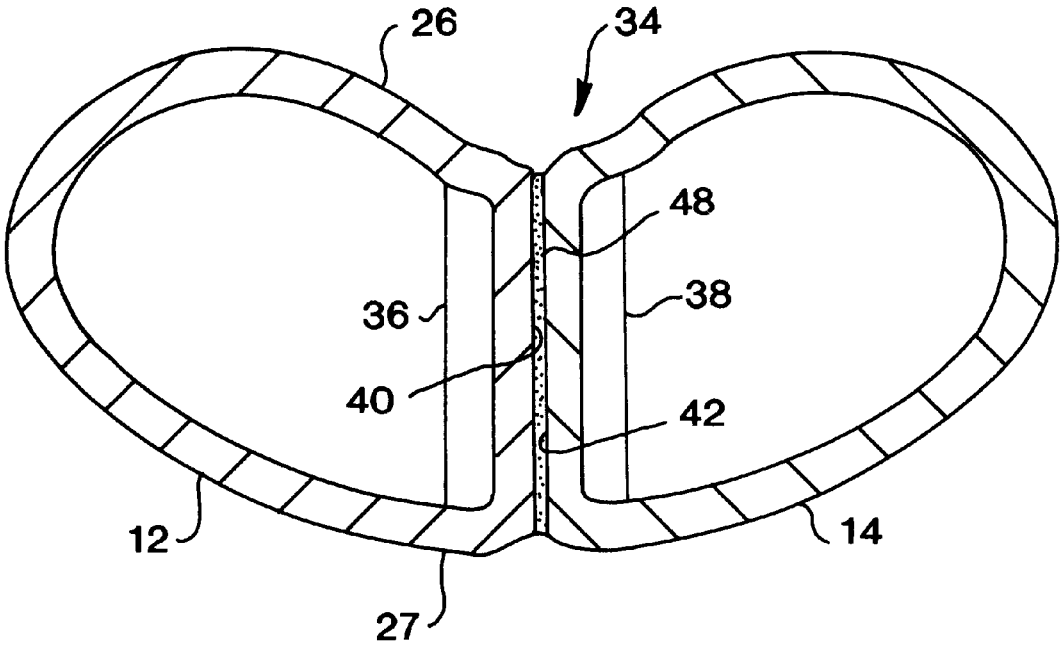
FIGS. 3 and 4 are cross sectional views of the frame of FIG. 2, taken in the direction of lines 3—3 and 4—4, respectively.
Figure 4:
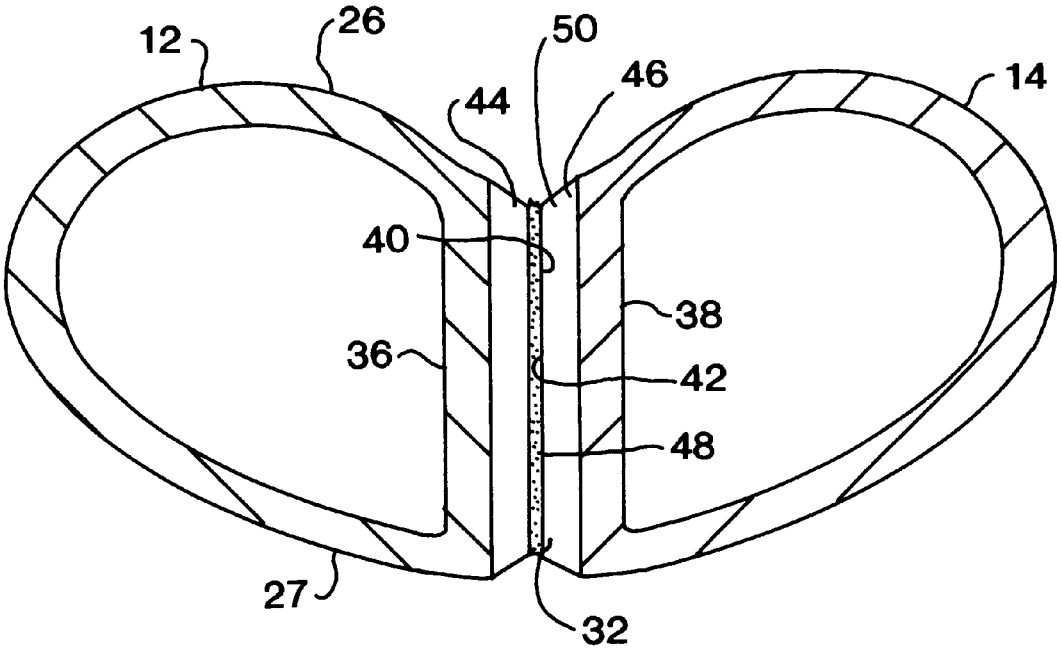

Referring to FIGS. 1–2, a racquet according to the invention has a frame 10 with upper and lower frame halves 12, 14 forming a head portion 16, a throat bridge portion 18, a pair of shafts 20, 22, and a handle portion 24. The head portion has an outer frame surface 26, and an inner frame surface 27 defining a generally oval stringing area containing main string segments 28, extending parallel to the racquet axis 29, and cross-string segments 30 extending perpendicular to the racquet axis 29. The strings 28, 30, are interwoven in a conventional manner to form a generally planar string bed. The ends of the string segments 28, 30 are received in string holes 32 where, in a typical fashion, they exit the string hole, extend along a stringing groove 34 to the next string hole, and re-enter the stringing area. Although the example shown is an open throat frame with orthogonal stringing, other frame shapes, such as monoshaft frames, and other string orientations, may be employed.

Figure 5:
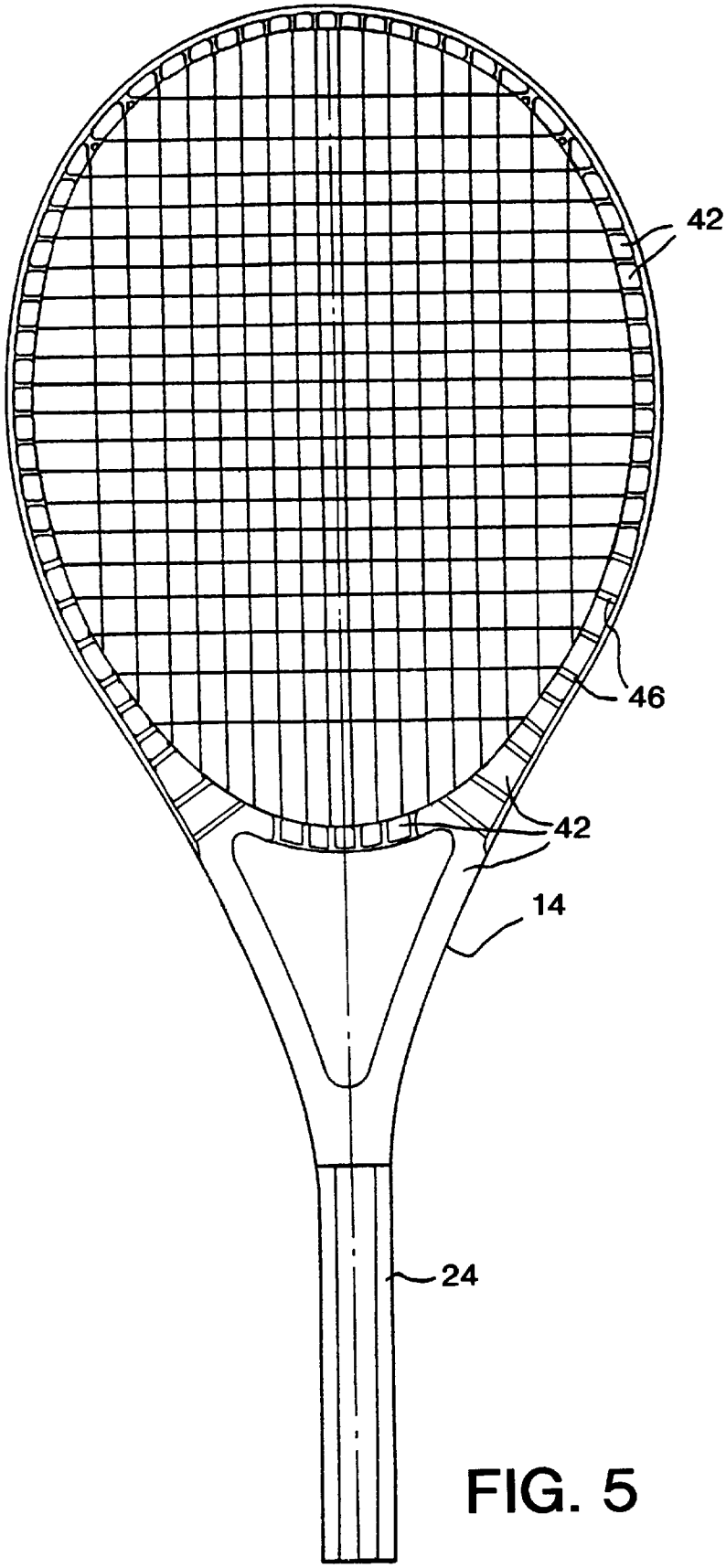
FIGS. 5 and 6 are plan views of the two racquet halves.
Figure 6:
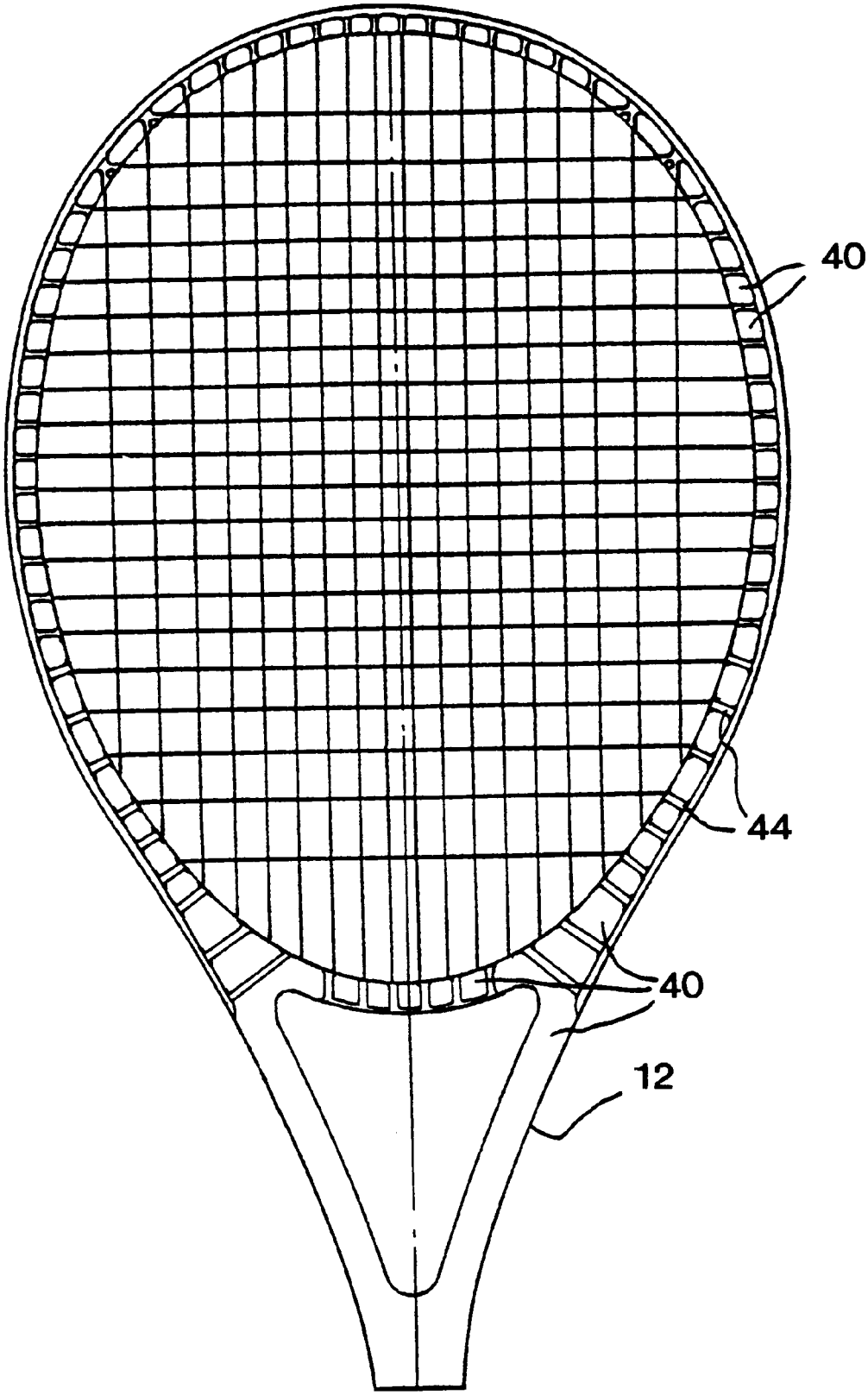

Referring to FIGS. 3–8, each frame half 12, 14 is a tubular frame section. The upper frame half 12 includes a first wall 36, and the lower frame half 14 has a second wall 38, each of which includes opposed, generally planar wall surfaces 40, 42 which are parallel to the string bed plane. As shown in FIGS. 5–6, the planar wall surfaces 40, 42 are provided around the head portion 16, the throat bridge portion 18, and the shafts 20, 22. The first and second walls 36, 38 also include a plurality of channel portions 44, 46, each of which defines a portion of a string hole 32.

In the example shown in FIGS. 1–8, the two frame halves 12, 14, in the head 16, throat bridge 18, and shafts 20, 22, are mirror images of one another. The handle portion 24 is molded to be a unitary part of the lower frame half 14, and is preferably a hollow, tubular molded-in handle as is well known.

The two frame halves 12, 14 are assembled by applying a suitable adhesive 48 to the planar wall surfaces 40, 42 on one of the two halves 12 or 14, and bringing the two frame halves together as shown in FIGS. 2–4 and 8. When the two frame halves 12, 14 are brought together, the channel portions 44, 46 form complete string holes 32. Also, the two planar wall surfaces 40, 42 will lie symmetrically on either side of the string bed plane.

Figure 7:
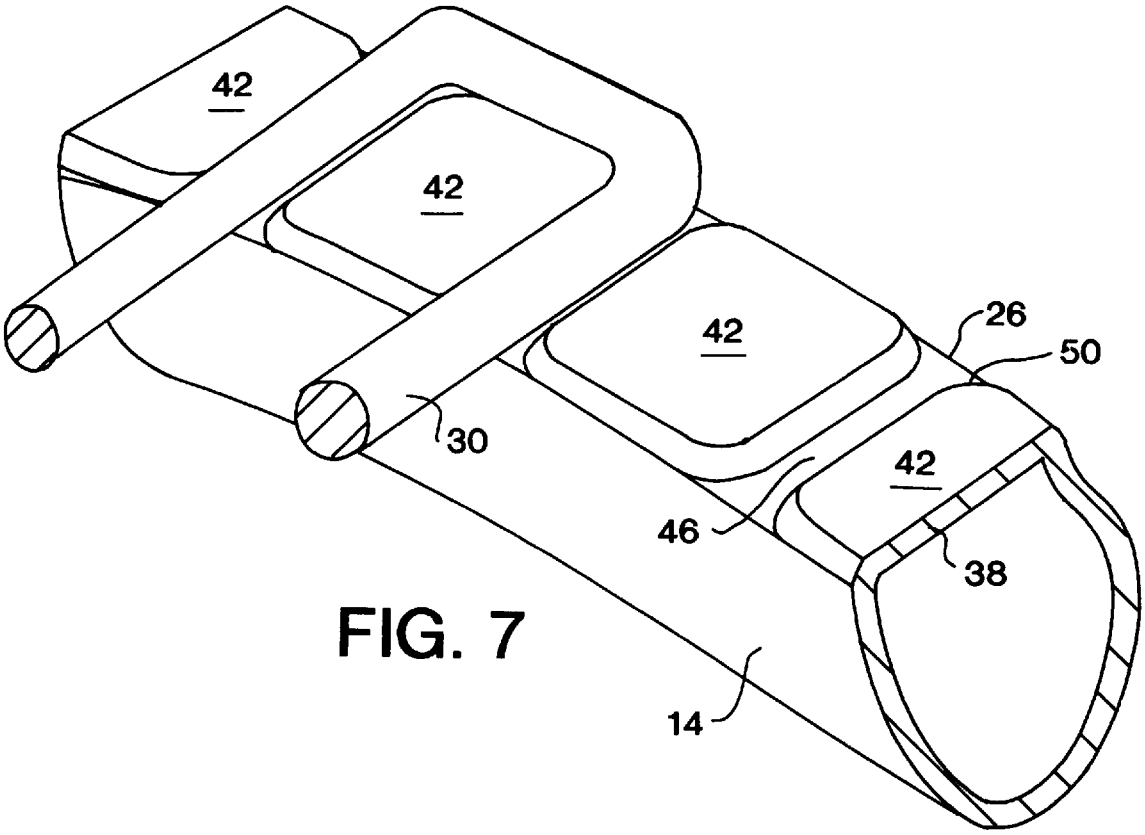
FIG. 7 is a perspective view of a section of racquet frame.
Figure 8:
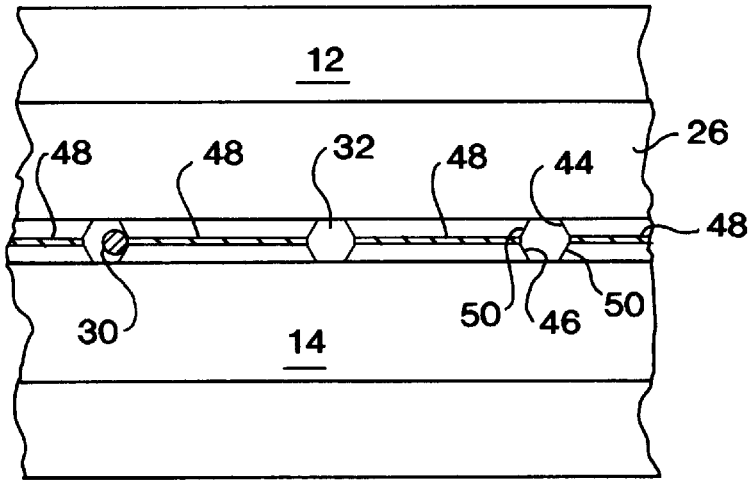
FIG. 8 is an enlarged, side view of a section of the racquet shown in FIG. 2.

As shown in FIGS. 7–8, the channel portions 44, 46 are radiused at the entrance 50 to the string holes 32 on the outer frame surface 26. In this manner, strings 28, 30 entering and leaving the string holes 32 bend around the radiused entrance 50 rather than around a string hole sharp edge, as illustrated in FIG. 7.

Figure 9:
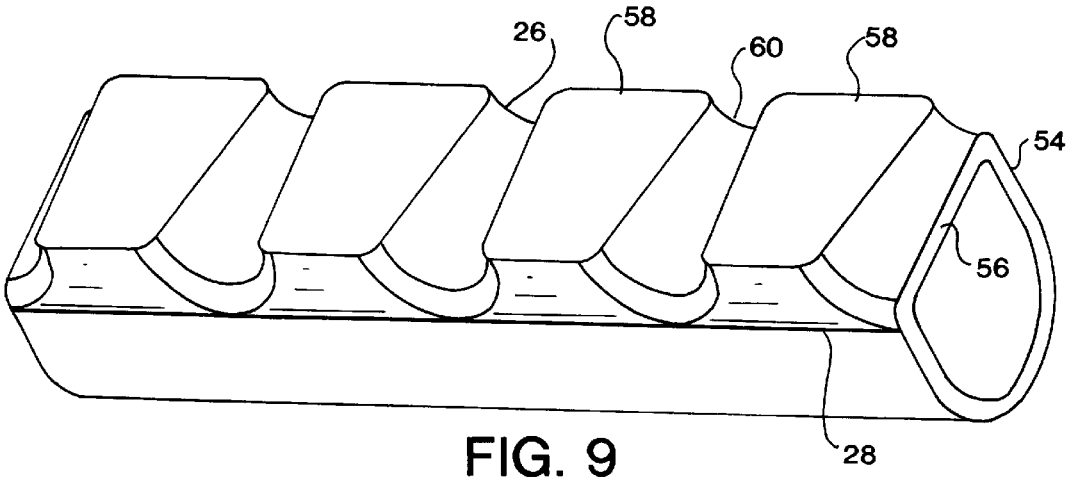
FIG. 9 is a perspective view of a section of an alternative embodiment of a racquet frame half, the other half being a mirror image thereof.

FIG. 9 shows an alternative embodiment of a hollow tubular frame half 54. The frame half 54 includes a first wall 56 with planar wall surfaces 58 separated by channel portions 60 forming half a string hole. The channel portions 60 are flared toward the inner frame surface 27, so that the diameter of the holes increases from the outer frame surface 26 towards the inner frame surface 27. The string holes, when the racquet halves are joined, are frusto-conical in shape, and strings entering such string holes are constrained against movement at the frame outer surface 26 only, being free to move within the remainder of the string hole. In this manner, when a ball impacts the string bed, the strings are free to move in a direction perpendicular to the string bed, the anchor points for the string ends effectively being at the outer frame surface 26. In this manner, the effective string length is increased, thereby increasing power.

Figure 10:
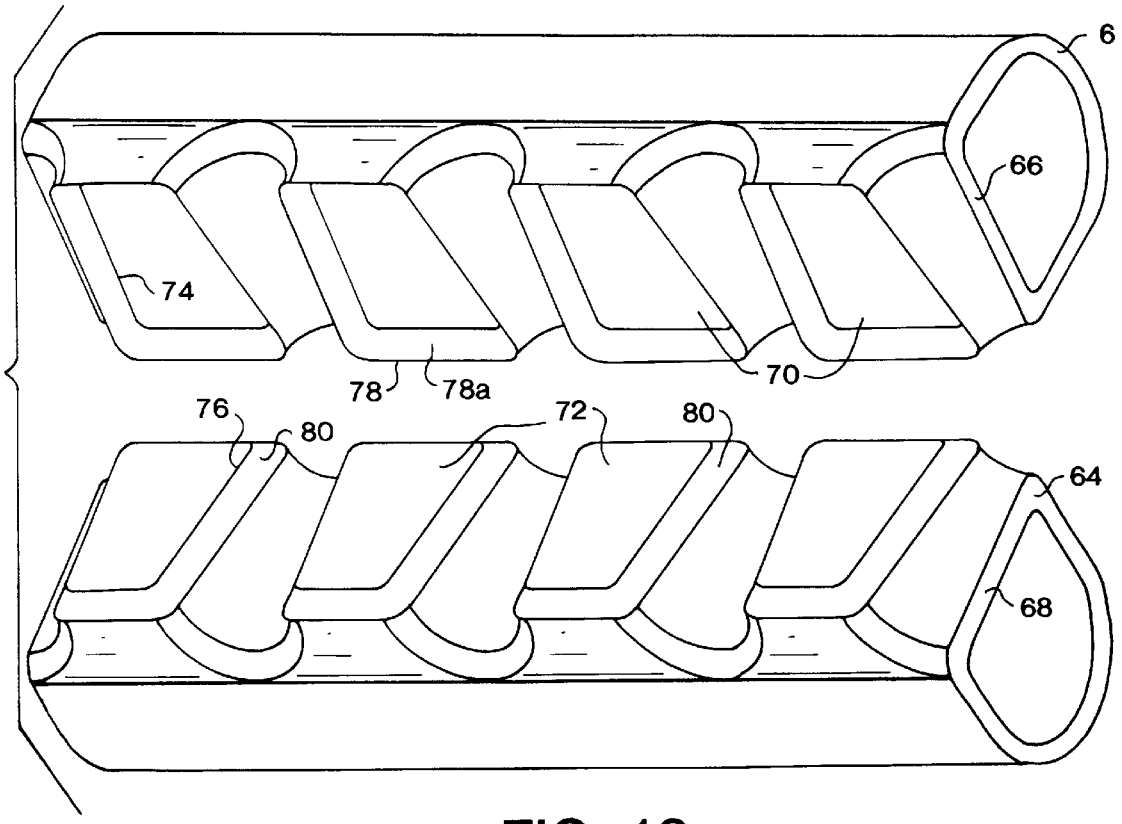
FIG. 10 is a perspective view of a section of two racquet halves of another embodiment, prior to being joined together.

FIG. 10 shows another embodiment in which the two hollow tubular frame halves 62, 64 are complementary to, but not mirror images of, one another. As in the other embodiments each frame half 62, 64 includes a wall 66, 68 with planar wall surfaces 70, 72 which are parallel to the string bed plane. Each of the planar wall surfaces 70, 72 has an outer peripheral edge 74, 76. A peripheral ridge 78, with a bevel shaped interior surface 78*a*, projects from each peripheral edge 74 towards the other frame half 64. Each peripheral edge 76, in turn, has a mating beveled recess 80. When the two racquet halves are glued together, the mating beveled surfaces act to seat the two halves exactly in their correct relative position.

Figure 11:
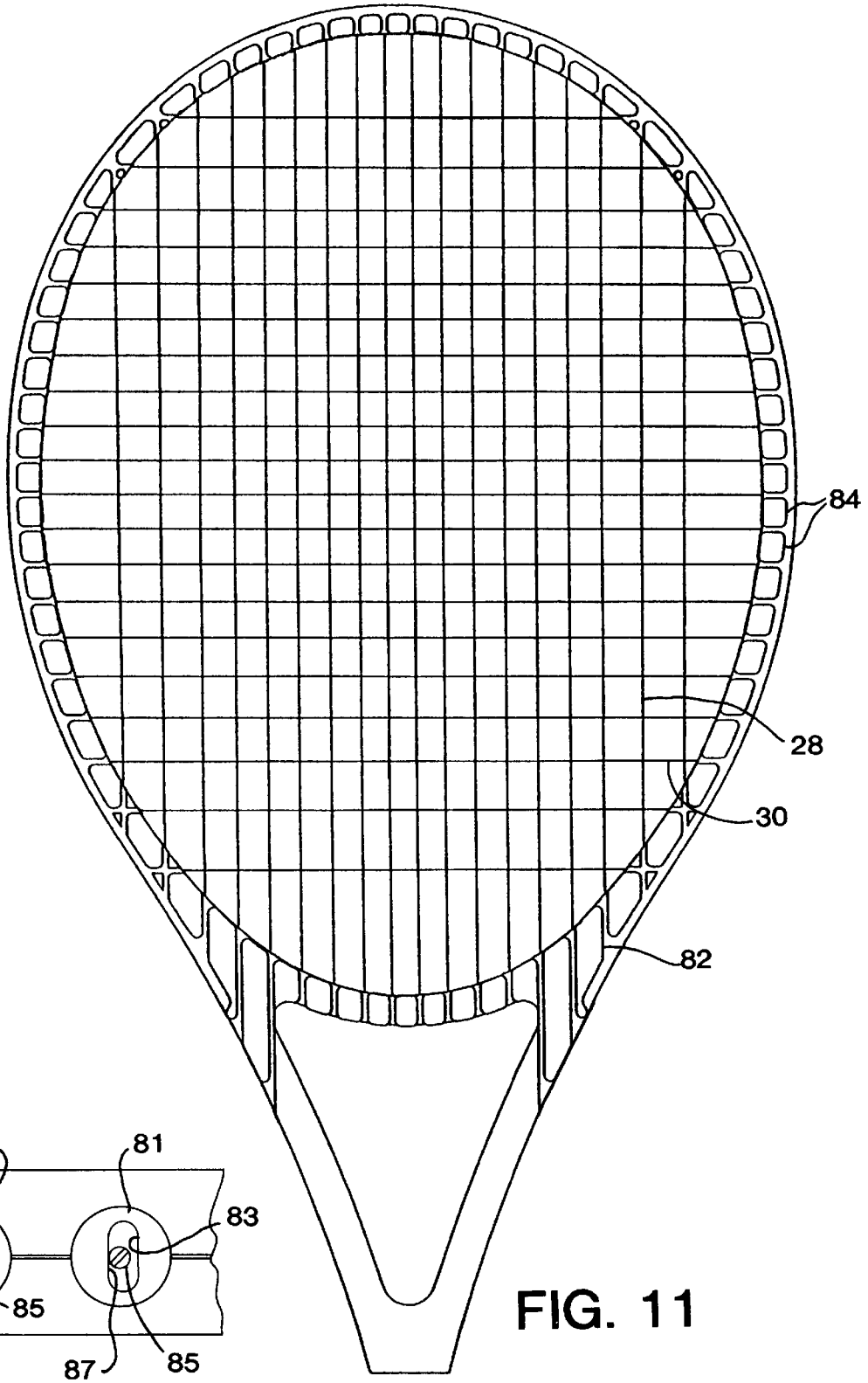
FIG. 11 is a plan view of another embodiment of a racquet frame half.

In the FIG. 11 embodiment, the channel portions 82, rather than extending perpendicular to the tangent of the frame, extend in the same direction as the string segments 28, 30 which they support. The ends of the string segments are preferably supported only at the outer frame surface 84 (e.g., using conical string holes such as in FIG. 9) so that, except for the anchor points, the strings are free to move in a direction perpendicular to the string bed. The FIG. 11 embodiment is otherwise similar to the embodiment of FIGS. 1–8, and may employ the mating beveled surfaces of FIG. 10 if desired.

Figure 11A:
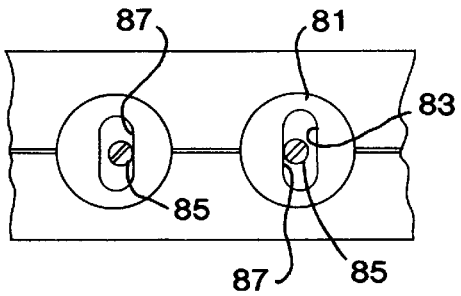
FIG. 11*a* is a side view of a portion of the inner frame wall of the head portion of a racquet constructed with frame members as shown in FIG. 11.

FIG. 11*a* shows a portion of the racquet frame according to FIG. 11, looking from inside the strung surface area, after the two halves have been joined. Grommet pegs 81 include grommet holes 83 which are slotted, i.e., elongated in a direction perpendicular to the string bed. In this manner, the strings are constrained against movement, in a direction perpendicular to the string bed, only on the outside of the frame, where they enter the string holes. As shown, the strings 85 bear against one of the flat sidewalls 87. Upon ball impact, the strings will be deflected, but after the ball leaves the string bed the strings will rub against the sidewall 87, thereby damping vibration. A slotted grommet stringing system providing such string damping is disclosed more fully in commonly owned U.S. application Ser. No. 08/772,441.

Figure 12:
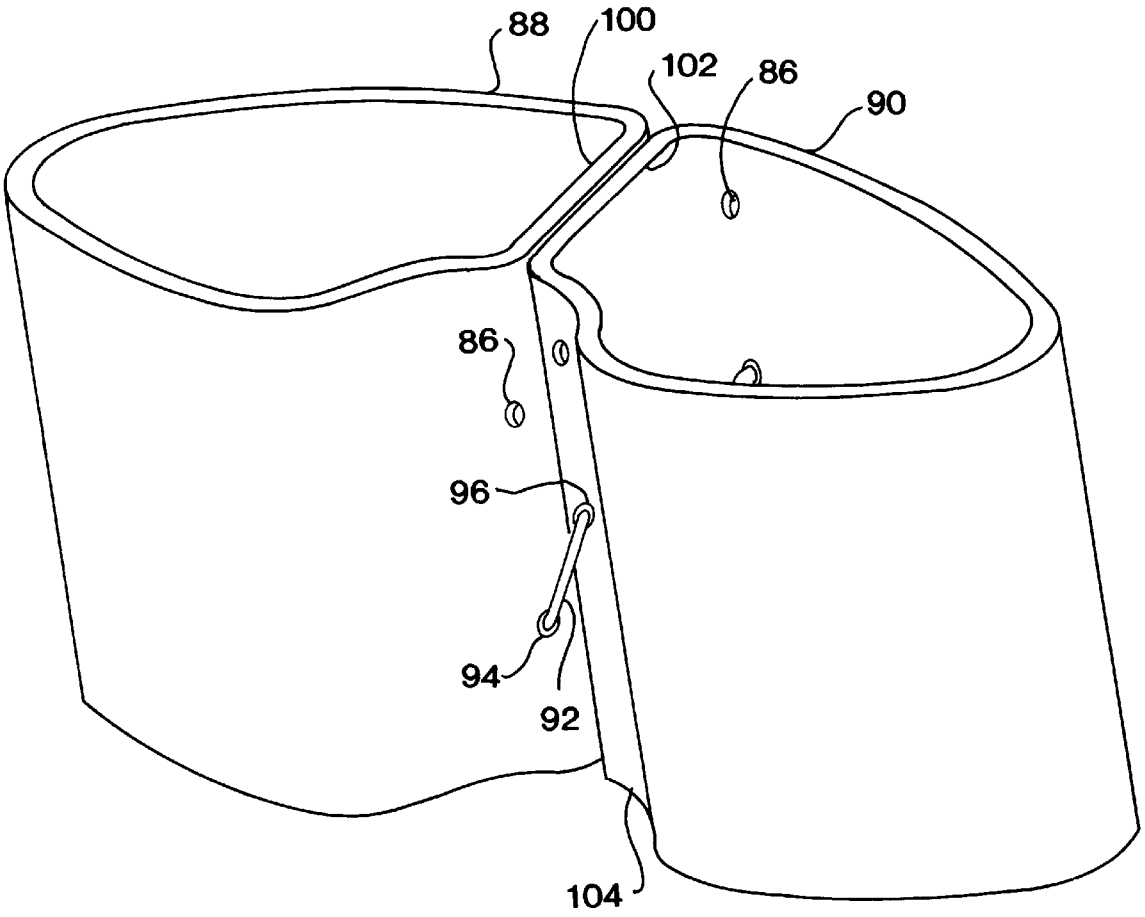
FIG. 12 is a perspective view of a section of a racquet frame according to another embodiment.

FIG. 12 discloses an alternative embodiment in which the string holes 86 are drilled after the frame halves 88, 90 are molded, either before or after the halves are joined. As shown, preferably the string holes 86 are formed alternately through opposite frame halves 88, 90, i.e., so as to lie alternately on opposite sides of the internal ribs 100, 102 formed when the two frame halves 88, 90 are bonded together. In this manner, when a string 92 leaves one string hole 94, and extends on the outer frame surface 96 to the next string hole 98, it crosses on top of the internal ribs 100, 102. In this embodiment, because the holes are drilled, it is preferable to utilize a plastic grommet strip with grommet pegs. The grommet strip (not shown) may be conventional, except that the grommet peg locations are altered so as to match the string hole locations, and may be disposed in the stringing groove 104 formed by the two frame halves.

Figure 13:
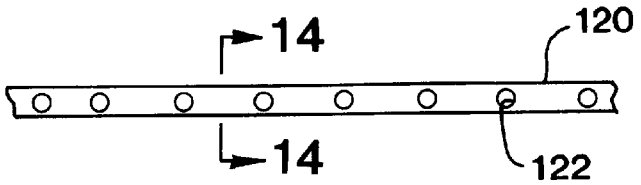
FIG. 13 is a top view of a portion of a grommet strip for use with the present invention.
Figure 14:
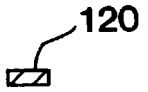
FIG. 14 is a cross-sectional view of the grommet strip, taken through lines 14—14 of FIG. 13.
Figure 15:
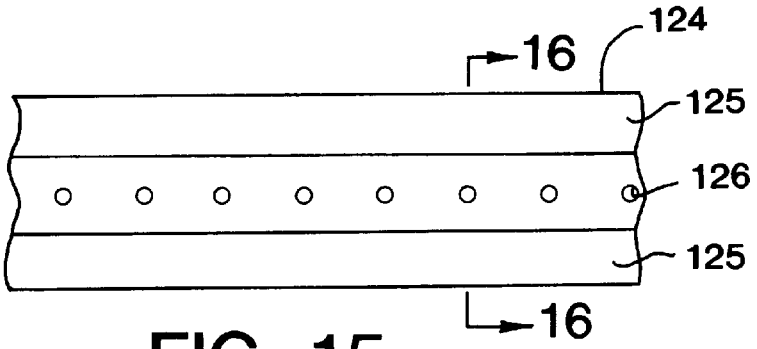
FIG. 15 is a top view of a portion of a bumper strip for use with the present invention.
Figure 16:
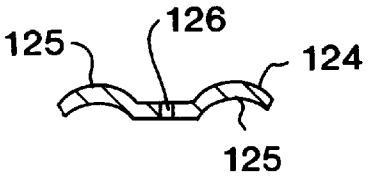
FIG. 16 is a cross-sectional view of the bumper strip, taken through lines 16—16 of FIG. 15.

FIGS. 13–15 show suitable grommet and bumper strips for the frame according to the invention. Grommet strip 120 is similar to conventional grommet strips, except that, according to the present invention, it may be made less wide and thinner than conventional grommet strips. Also, while conventional grommet strips include grommet pegs which extend through the holes in the racquet frame, in order to protect the string from the sharp edges on both the inner and outer frame walls, as shown in FIG. 14 grommet pegs are not required, due to the fact that the string hole walls in the frame of the present invention are smooth and extend all the way through the frame. Also, because the grommet strip 120 does not need to protect the string from sharp edges of the frame string holes, it can be made thinner than conventional materials and formed out of softer materials. A grommet strip 120 may be placed in the stringing groove 34 along the opposed sides of the frame, in the conventional grommet strip locations, such that the grommet strip holes 122 are aligned with the string holes in the racquet frame.

Bumper strip 124 is similar to conventional bumper strips, and includes a pair of flanges 125 extending laterally to either side. As in the case of the grommet strip 120, the bumper strip (particularly the central web portion carrying the string holes 126) may be thinner than conventional bumpers and made of a softer material. The bumper strip is place along the tip of the racquet, in the conventional bumper strip location, so that the bumper strip holes 126 are aligned with the frame string holes and the flanges 125 cover the outwardly facing wall of the frame.

Figure 17:
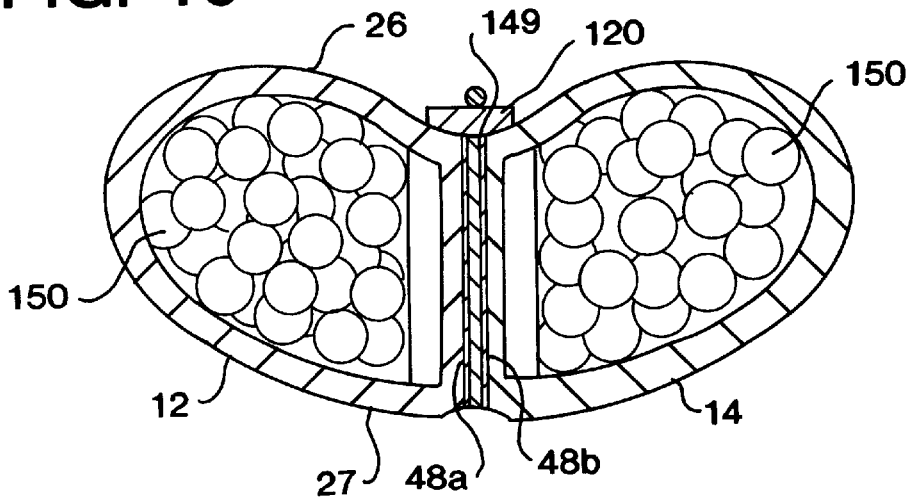
FIG. 17 is a cross-sectional view of the frame, corresponding to FIG. 3, showing a alternate embodiment.

FIG. 17 shows an alternative embodiment in which a thin layer of viscoelastic material 149 is sandwiched between the frame halves 12, 14. Two adhesive layers 48*a*, 48*b* are disposed between the facing surfaces of the two racquet halves and the opposite sides of the viscoelastic material 149. As also shown, the two racquet halves 12, 14 are filled with microballoons 150, which are extremely lightweight spherical particles. Two suitable products are Scotchlite™ Glass Bubbles (K15 6-1213-2093-90), manufactured by 3M, which have a density of about 0.5 lbs. per gallon. Another suitable product is Sphericle® Hollow Spheres (110 P8), manufactured by Potter Industries, Inc., Carlstadt, N.J. The use of microballoons adds little weight, but has the effect of quieting the racquet's performance. The microballoons may be used throughout the entire frame, or only in certain portions. For example, if it is desired to use microballoons only in the head, or only in the handle, one or more stoppers can be inserted into the interior of the upper and lower frame half tubes to confine the microballoons to the desired locations. Also, unlike conventional racquets where the string holes open the racquet interior to the outside, in the present invention the string holes walls extend through the frame. Thus, the interior of the tubes is sealed, and the microballoons will not spill out.

The thin layer of viscoelastic material may be interposed between all the contact surfaces of the two frame halves. Alternatively, the viscoelastic material may be bonded only to selected surfaces on the frame. For example, it may be desirable to provide the viscoelastic layer on certain locations to attenuate vibration, improve the fee, or reduce shock. In the latter case, the mold is configured so that the opposed frame surfaces, between which the viscoelastic material will be placed, are properly spaced to accommodate the thickness of the viscoelastic layer.

In the case of FIGS. 1–11, each of the racquet halves is pre-molded, using well known inflation molding techniques. In accordance with such techniques, a tube of pre-preg material, which is preferably carbon fiber and epoxy, is placed in a mold having the desired shape of the racquet half. A bladder inside the pre-preg tube is inflated, such that that the pre-preg tube assumes the shape of the mold, and the mold is heated to cure the epoxy resin so that the frame half hardens.

The two pre-molded tubes are adhesively bonded together using a "B-stage" epoxy pre-preg film adhesive sheet, which is placed over one half frame, while the other frame half is placed face-to-face on top. The racquet halves are clamped together to apply a uniform pressure and heated to a suitable temperature to cure the resin.

The use of an epoxy film adhesive is preferred over the use of liquid adhesive for several reasons. Such adhesive sheet contains a scrim cloth material which maintains a predetermined spacing, preferably about 0.005 inch, between the abutting surfaces 40, 42, therefore ensuring that a proper thickness of epoxy is present to form a solid joint. It also avoids the problem of excess liquid epoxy running down the side walls of the frame tube, which would require a difficult removal process. Film adhesive, in contrast, sticks to the frame only where it is in pressure contact. Excess adhesive which hangs over the frame edges or which is located in the string holes cures while suspended in air, and is easily removed in a manner similar to removing cured epoxy flashing after molding the frame. Thus, any scrim cloth projecting out of the frame is easily torn away after the frame is clamped together, by die cutting the film.

The embodiment of FIG. 12 may be formed in a manner similar to that described above. Alternatively, one of the frame halves can be pre-molded, and the other frame half co-cured by molding it directly onto the pre-molded half In such a case, the first frame half is molded from a pre-preg tube in a conventional manner. The pre-molded half is then placed inside a second mold, in the desired shape of the finished frame, and a second pre-preg tube is placed inside the second mold, and inflated and heated to complete the frame. The precured half s flat bond surface serves as a tool for the uncured half The two halves are bonded together by resin from the uncured racquet half. Co-curing eliminates bond line irregularities such as mismatched bonding surfaces or unbonded regions because the molding pressure causes the uncured half to conform to the pre-cured surface. The result is a strong, uniform joint, and eliminates the weight of the adhesive layer.

Also, in this embodiment the string tension can be utilized to improve the joint integrity. By alternately locating the string holes on opposite sides of the internal ribs, the tensioned strings hold the two racquet halves together by crossing over the interior ribs as they ride in the string groove. The string cross-over pattern is repeated along the entire string groove and effectively weaves the two halves together, thereby providing additional resistance to join separation.

According to another aspect of the invention, it is preferable to mold the frame halves with a peel ply material covering the planar surfaces 40, 42 as well as the string hole-forming channels. The peel ply material is made of a suitable woven synthetic cloth, such as nylon or dacron, and placed into the mold on the mold surface forming the planar surfaces 40, 42 and string hole channels. The cloth will not adhere to the molded part by chemical cross-linking, but merely by slight mechanical forces due to resin seeping between the woven threads, and therefore can readily be peeled off when it is desired to adhere the two racquet halves.

The peel strip protects the planar bonding surfaces 40, 42 from foreign substances which might subsequently interfere with bonding. The peel ply also assures a clean textured surface without any excessive pooling of resin, and without any voids which lack fibrous support.

Another significant advantage of molding the racquet halves with a peel strip of cloth over the contact surfaces is that, when peeled off, the exposed surface of the planar wall sections 40, 42, 58, 70, 72 will be textured rather than smooth. This rough surface finish will provide a better surface for holding the epoxy resin.

Preferably, also, the film adhesive is die cut with a serrated pattern which will tear off easily after the two pre-molded frame halves have been positioned with the film adhesive located between. In such a manner, all excess adhesive is removed prior to bonding, creating a clean finished part.

In place of using a film adhesive, any other suitable process for applying a superglue may be employed. For example, uncured epoxy may be applied to the facing surface, and cured to a B-stage. Thereafter, the racquet halves are joined, and excess epoxy can be torn off The epoxy is then cured. Alternatively, a light, fibrous carrier can be positioned over one of the contact surfaces, whereafter epoxy is applied to the carrier. After curing, the carrier can be torn off. Epoxy may also be applied with a roller or pad. Preferably, when applying epoxy with a roller or pad, a relatively viscous liquid adhesive is employed containing a particulate filler, in order to maintain a predetermined glue line thickness, e.g., 5 mm. Alternatively, however, adhesive can be sprayed onto the contact surfaces, using a mask placed over the racquet half to expose only the desired contact areas. The adhesive dispenser may also be programmed to apply different amounts of adhesive on different areas of the racquet. Preferably, either the sprayed adhesive contains a particulate filler, or the contact surfaces are covered with a fibrous carrier in order to maintain the desired glue line thickness.

Figure 23A:
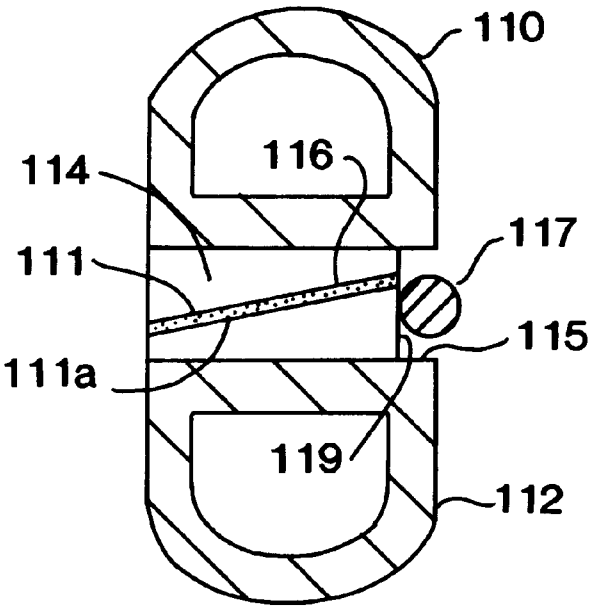
FIG. 23*a* is a cross-sectional view of the two frame halves of FIG. 23, after being joined together.
Figure 23:
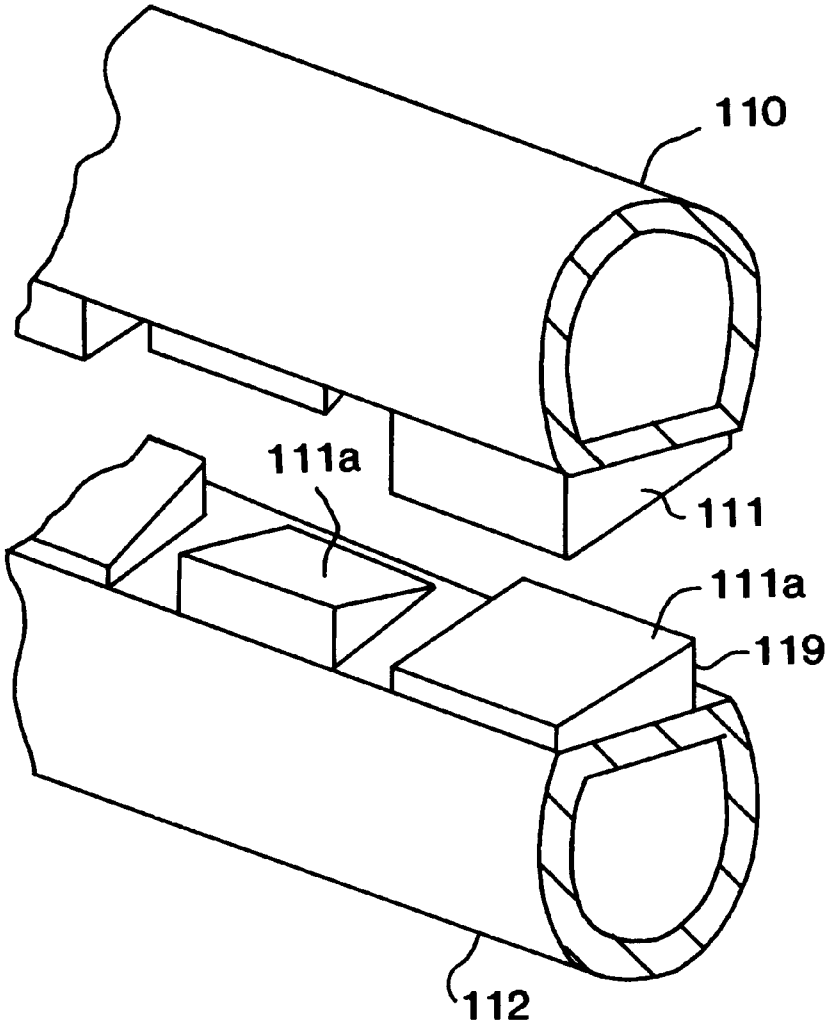
FIG. 23 is a perspective view of two frame halves, showing another embodiment of the invention.

In another embodiment illustrated in FIGS. 23 and 23*a*, the opposed wall surfaces 111, 111*a* of the two frame halves 110, 112, are angled relative to the string bed plane. In the illustrated example, the opposed wall surfaces 111, 111*a* on each racquet half are alternately angled in opposite directions. As shown in FIG. 23*a*, when the two racquet halves 110, 112 are joined to form a string hole 114, the glue line 116 between the opposed wall surfaces 111, 111*a* lies at an angle to the string bed plane, so that, as the strings 117 extend along the string groove 115 on the outside of the frame, they are not lined up with the glue line 116. Preferably, the opposed surfaces 111, 111*a* are shaped so that the outwardly facing edges 119 of the string holes 114, i.e., where the string 117 enters the string hole 114, are rounded.

In FIGS. 23 and 23*a*, the two racquet halves 110, 112 are shown as being symmetric. However, if desired, they may be asymmetric. The principal feature of this embodiment is to shape the two opposed surfaces 111, 111*a* so that, along the outside of the frame, in the stringing groove 115, the glue line is towards the upper or lower end of the groove, i.e., so as not to be coincidental with the string 117.

With the present invention, it is possible to utilize a smaller string groove with a width smaller than a conventional racquet (typically about 2.8 mm). In the case of racquets which do not utilize grommet and bumper strips, the string groove need only be wide enough and deep enough to accommodate the diameter of the string. Even where bumper and grommet strips are used, the fact that grommet pegs are not required, and thereby the string holes through the frame are smaller than conventional string holes, and the fact that the grommet thickness can be reduced, allow a corresponding decrease in the width and depth of the string groove. Having a smaller string groove, in turn, increases the strength of the outer sidewall of the frame.

Figure 18:
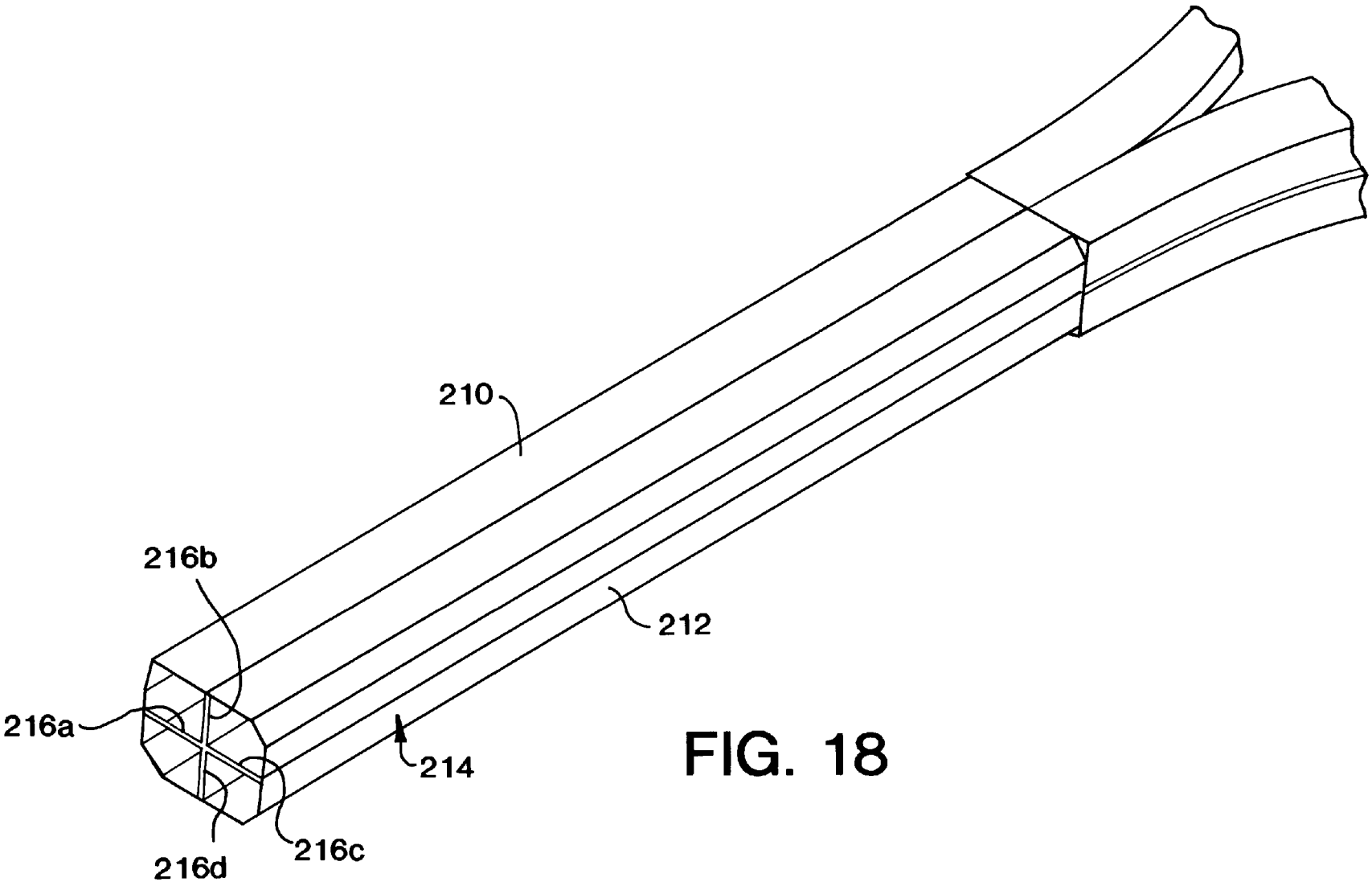
FIG. 18 is a perspective view of the frame and shaft portions of a racquet containing an alternate embodiment.

FIG. 18 shows the handle and shaft portions of a modification to FIGS. 1 and 2. Both the upper racquet half 210 and the lower racquet half 212 are molded with half of the handle member 214. As shown, when the upper and lower halves 210, 212 are glued to one another, the handle portion 214 has an octagonal outer shape. The interior of the handle 214 then has four internal ribs 216*a–d*. The handle 214 may be wrapped with a conventional grip for play.

Figure 19:
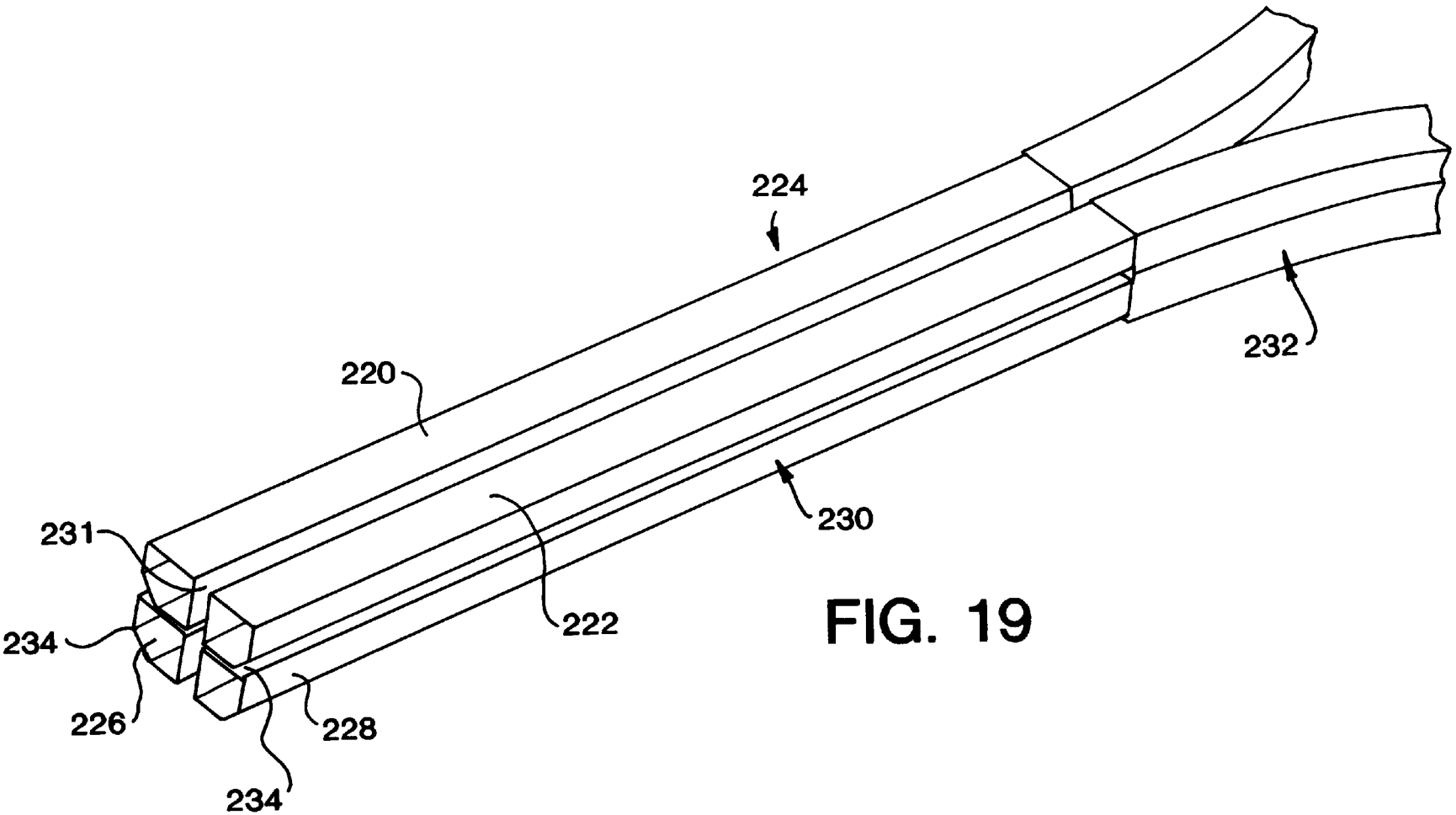
FIG. 19 is a perspective view of the frame and shaft portions illustrating another embodiment.

FIG. 19 shows an alternative embodiment in which the two tubes 220, 222 of the upper frame half 224, and the two tubes 226, 228, of the lower frame half 230, are molded so as to be separated from one another by a gap 231. Furthermore, when the upper and lower frame halves 224, 230 are adhered to one another in the shaft portion 232 and head portion (not shown), there is a gap 234 formed between the upper half tubes 220, 222 and the corresponding lower half tubes 226, 228. If desired, a viscoelastic material may be provided in the gap 231 or the gap 232, or both. Such viscoelastic material can be bonded to one or both of the opposed walls, as described in connection with FIG. 17, but does not have to be.

Figure 20:
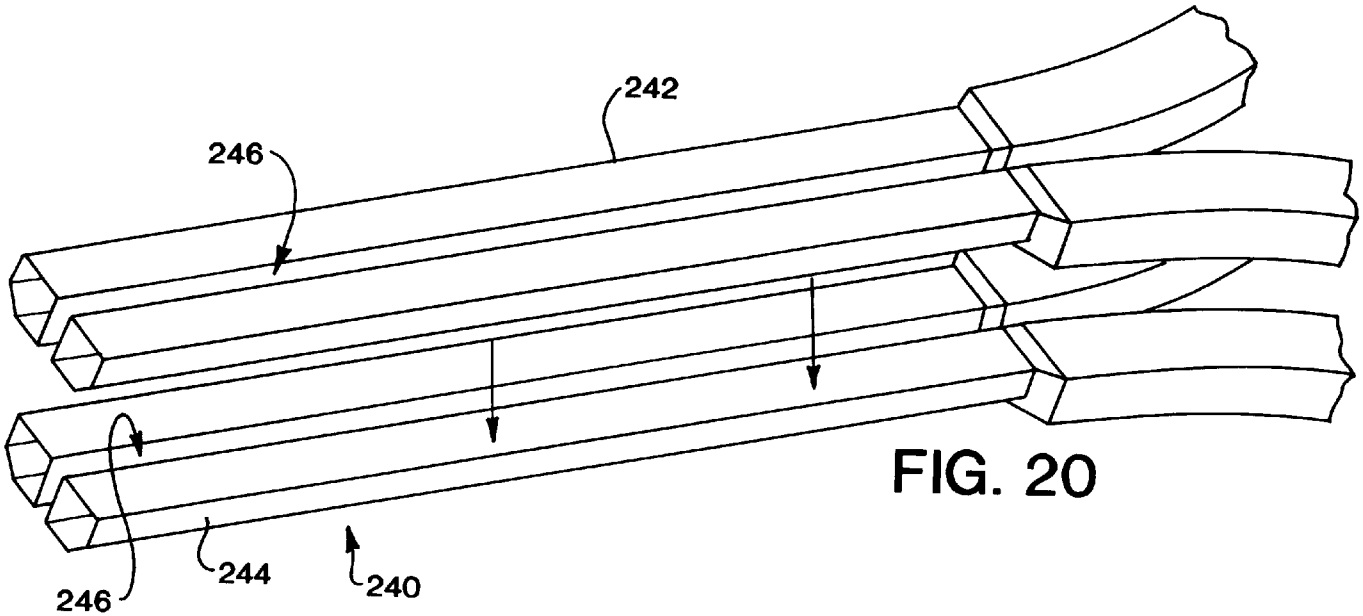
FIGS. 20 and 21 are perspective views of the frame and shaft portions of two racquet halves according to another embodiment, prior to and after joining.
Figure 21:
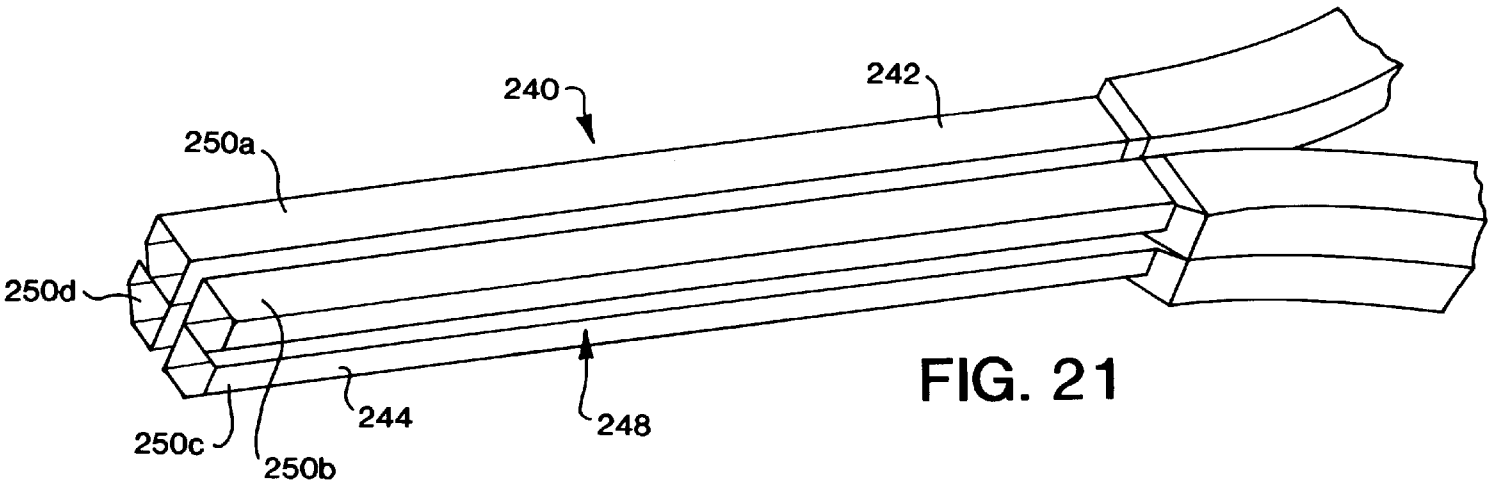

FIGS. 20–21 show another embodiment of racquet handle 240. As shown in FIG. 20, each racquet half 242, 244 is molded so that the handle portion is formed of a pair of spaced tubes, with a gap 246 therebetween as in the case of FIG. 19. As opposed to FIG. 19, where the four tubes defined the outer shape of the handle, when the two racquet halves are joined, the upper and lower handle tubes form a shaft 248 of uniform cross-section. The four shafts 250*a–d* are all spaced from one another. The shaft 248 is designed to accept a slide-on pallet forming a handle, such as disclosed in commonly owned U.S. Pats. No. 5,034,082 or No. 5,599,019. In the case of the lockable slide-on pallet disclosed in the '019 patent, the outer shaft surface would be molded into a suitable shape.

Figure 22:
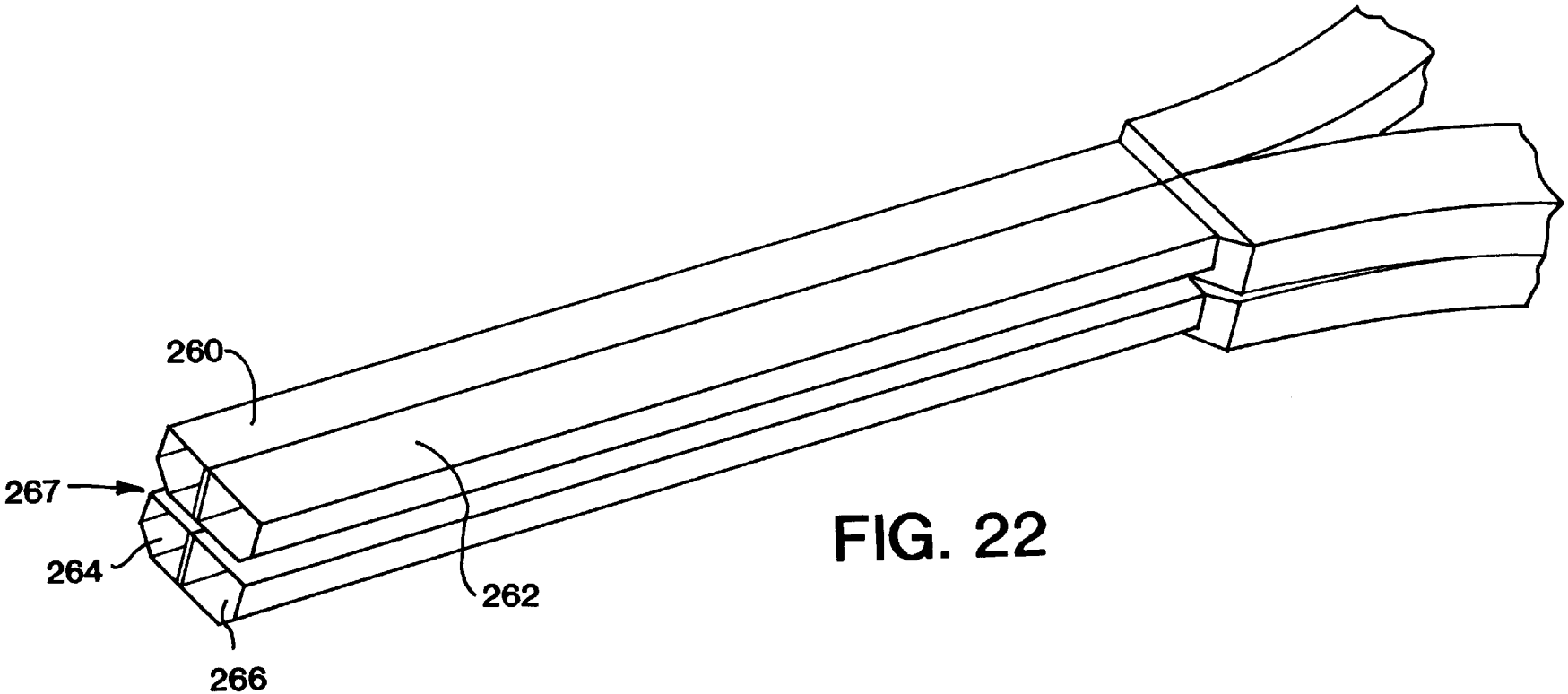
FIG. 22 is a perspective view of the frame and shaft portions illustrating a modification of FIG. 21.

FIG. 22 discloses a modification of the racquet shown in FIGS. 20–21 in which, rather than having all four tubes freely suspended, the handle tubes 260, 262 of the upper racquet half are molded so as to be bonded to one another, and the handle tubes 264, 266 of the lower racquet half are similarly bonded to one another. The upper tubes 260, 262 are spaced from the two lower tubes 264, 266, however. If desired, viscoelastic material can be disposed in the gap 267 between the two tubes.

Alternatively, if desired, the upper tube 260 could be bonded to the lower tube 264, and the upper tube 262 could be bonded to the lower tube 266, but the two upper tubes 260, 262 and the two lower tubes 264, 266 would not be not bonded to one another. Again, if desired, viscoelastic material could be disposed in the gap between the unjoined tubes.

Thus, as described above, the racquet handle portion may be split only in the direction of the string plane, with viscoelastic material placed in the gap, or may be split at right angles to the string plane (again with viscoelastic material placed in the gap), or may be split both parallel to the string plane and perpendicular to the string plane. The viscoelastic material may, but does not need to be, bonded to the facing surfaces.

Also, the handle tubes can be separated in the throat shaft area (i.e., above the handle tubes), and rejoined in the handle pallet area. Or, the handle tubes can be separated at he throat shaft area, twisted to exchange position its opposing handle shaft tube (in spaghetti fashion), and resume its equal but opposite position with respect to the other handle shafts in the handle pallet area.

Figure 24:
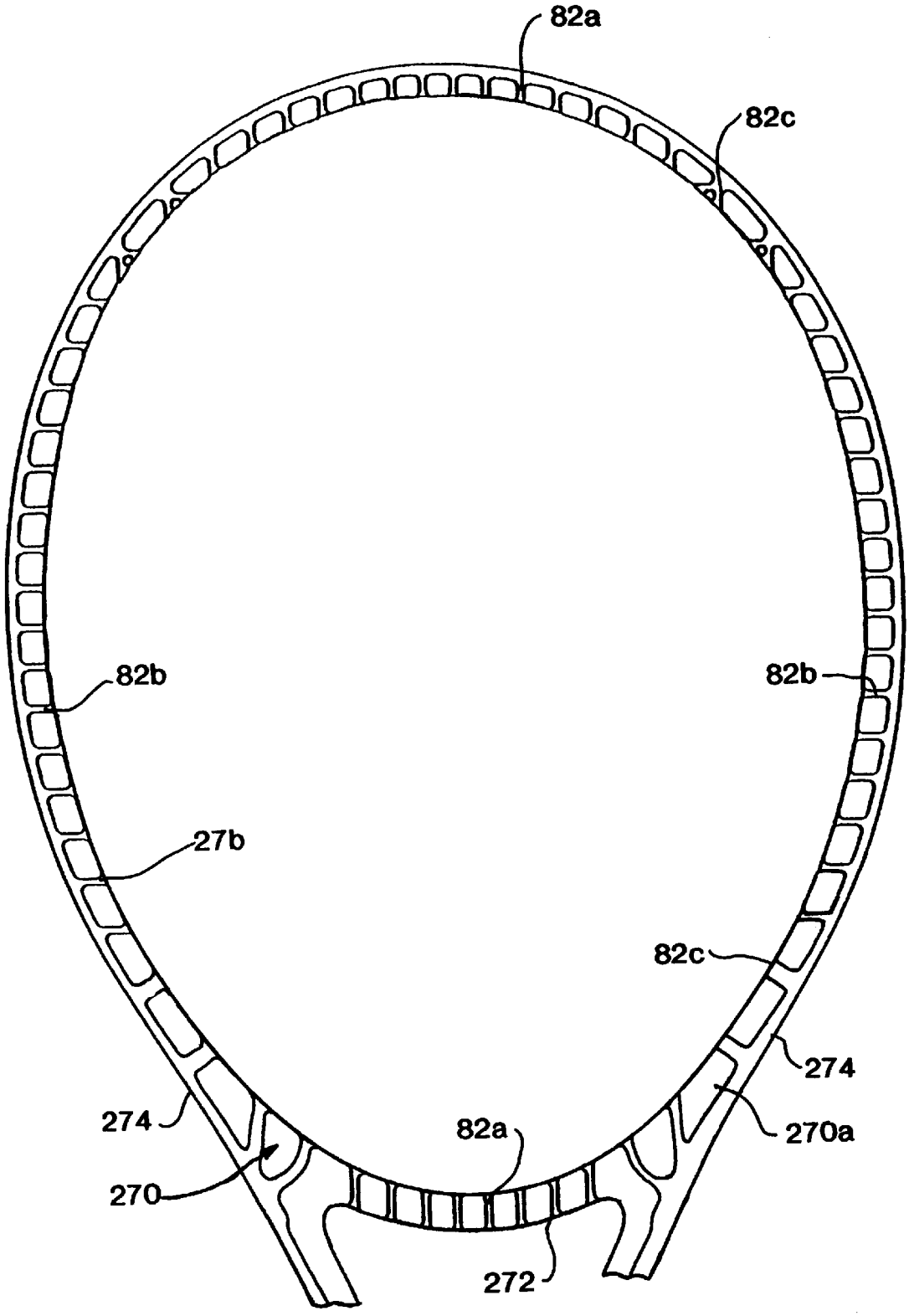
FIG. 24 is a front view of the head and throat portions of another embodiment of a racquet frame half.
Figure 25:
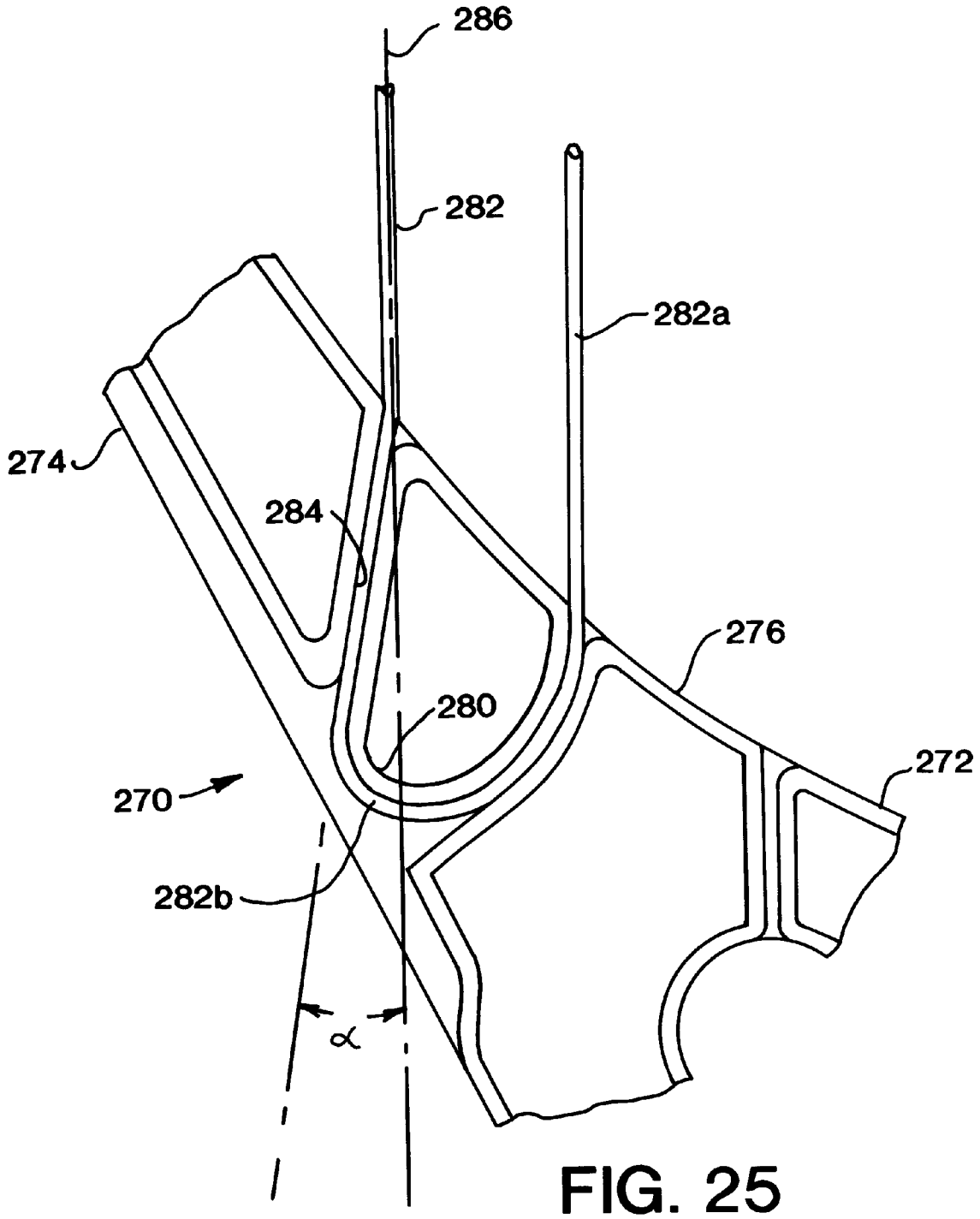
FIG. 25 is an enlarged front view of a portion of the embodiment of FIG. 24, where the throat bridge meets the main tubular frame.

FIGS. 24 and 25 illustrate a modification of FIG. 11 in which the channel portions 82*a* for the vertical strings, and the channels portions 82*b* for the cross strings, are parallel to the string direction except in the upper and lower comers of the head portion where, for example, channel portions 82*c* are perpendicular to the tangent of the frame. Moreover, in each of the two throat bridge joints 270, 270*a* (i.e., where the throat bridge 272 joins the main frame tube 274), each frame half, e.g., frame half 276, defines a curved, wrap-around bearing surface 280 around which the string 282 wraps to reverse direction. More particularly, the frame half 276 (as well as the mating frame half, not shown) includes a first string passage 284, extending from the inside to the outside of the frame, which is generally straight. In the example, passage 284 is angled at a small angle $\alpha$, e.g., 10 degrees, relative to the string axis 286 (which in this example is parallel to the racquet axis). The curved, wrap-around bearing surface 280 joins the passage 284 so that the main string segment 282 reverses direction and exits the frame 276, as main string segment 282*a*, in a direction parallel to the racquet axis.

The wrap-around curved bearing surface 280 shown in FIG. 25 is preferable for use at the throat bridge joints 270, 270*a* to avoid a sharp turnaround angle for the string that would occur if the outside bearing surface were to follow the outside curvature of the frame. The wrap-around surface 280 functions similar to wrapping the lower end of the string around a power ring as disclosed in commonly owned U.S. Pat. No. 5,562,283, insofar as the two lengths of string 282, 282*a* may be tensioned at the same time, from the tip end of the racquet, because the connecting portion 282*b* of the two string lengths 282, 282*a* will, upon tensioning of either element 282, 282*a*, slide around the curved bearing surface 280.

While in the example shown in FIGS. 24–25, curved, wrap-around bearing surfaces 280 are employed only in the two lower corners of the racquet, at the throat bridge joints 270, 270*a*, if desired such curved, wrap-around bearing surfaces may be used at other locations, or throughout the racquet frame. For example, it may be desirable to use curved, wrap-around bearing surfaces on all the string holes for the lower ends of the main strings, so that the main strings can be tensioned entirely from the tip end of the racquet (i.e., two-at-a-time). Such wrap-around bearing surfaces may also be used for some or all of the cross-strings, e.g., to speed up the stringing process.

The foregoing represents preferred embodiments of the invention. Variations and modifications will be apparent to persons skilled in the art, without departing from the inventive concepts disclosed herein. For example, while the examples illustrate providing part of the string hole sidewalls (the walls lying perpendicular to the string bed plane) on each racquet half, if desired both sidewalls can be formed on one racquet half, or can alternately be formed on the two racquet frame halves. All such modifications and variations are intended to be within the skill of the art, as defined in the following claims.

We claim:

1. A sports racquet having a frame formed of a composite material with a head portion and a handle portion, wherein said head portion has an outer frame surface, an inner frame surface defining a stringing area, and a plurality of string holes for supporting a generally planar string bed, wherein said head portion is formed by an upper frame half and a lower frame half, wherein each frame half is a tubular frame section, wherein said upper frame half includes a first wall and said second frame half includes a second wall, wherein said first and second walls include opposed, generally planar wall surfaces along said head portion, and wherein said wall surfaces are bonded to one another to form a unitary head portion, whereby said first and second walls form internal frame ribs oriented generally parallel to the string bed plane and extending continuously around said head portion.

2. A sports racquet as defined in claim 1, wherein said upper and lower frame halves are pre-molded individually and said planar wall surfaces are thereafter glued to one another.

3. A sports racquet as defined in claim 2, wherein said first and second walls include a plurality of channel portions defining a portion of a string hole, wherein the channel portions of said first wall mate with the channel portions of said second wall to form complete string holes extending from said outer frame surface to said inner frame surface.

4. A sports racquet as defined in claim 3, wherein said channel portions are contoured at the outer frame surface to form curved bearing surfaces for string entry.

5. A sports racquet as defined in claim 4, wherein said frame halves define a string groove on said outer frame surface extending between at least some adjacent pairs of string holes.

6. A sports racquet as defined in claim 5, wherein said racquet has an axis, and further comprising a plurality of main string segments extending parallel to said axis and a plurality of cross string segments extending perpendicular to said axis, the opposite ends of each string segment being received in string holes, wherein the string holes receiving the main string segments are oriented parallel to said axis, and wherein the string holes receiving the cross string segments are oriented perpendicular to said axis.

7. A sports racquet according to claim 3, wherein said string holes have a dimension, in a direction perpendicular to the string bed plane, which is substantially greater than the diameter of standard racquet strings.

8. A sports racquet according to claim 7, wherein the string hole dimension is larger at the inner frame surface than at the outer frame surface.

9. A sports racquet according to claim 8, wherein said string holes are frusto-conical in shape.

10. A sports racquet according to claim 3, wherein one frame half has a plurality of projections extending from adjacent said planar wall surfaces towards the other frame half, and the other frame half has a plurality of mating recesses.

11. A sports racquet according to claim 10, wherein each planar wall surface has an outer peripheral edge, wherein said projections are in the form of peripheral ridges extending from the outer peripheral edges of the said one frame half, wherein said ridges include outer peripheral surfaces forming part of each string hole, and wherein said recesses are provided in the outer peripheral edges of the said other frame half.

12. A sports racquet according to claim 11, wherein said recesses have bevel shaped surfaces, and wherein said ridges include mating bevel shape internal surfaces which are bonded to the bevel shaped surfaces of said recesses.

13. A sports racquet as defined in claim 12, wherein said upper and lower frame halves are formed of fiber-reinforced epoxy.

14. A sports racquet as defined in claim 11, wherein said upper and lower frame halves are formed of fiber-reinforced epoxy.

15. A sports racquet as defined in claim 10, wherein said upper and lower frame halves are formed of fiber-reinforced epoxy.

16. A sports racquet as defined in claim 3, wherein said upper and lower frame halves are formed of fiber-reinforced epoxy.

17. A sports racquet as defined in claim 2, wherein said upper and lower frame halves are formed of fiber-reinforced epoxy.

18. A sports racquet according to claim 1, wherein at least most of said string holes are drilled alternately through said upper and lower frame halves so as to lie alternately on opposite sides of said internal frame ribs.

19. A sports racquet as defined in claim 18, wherein said upper and lower frame halves are formed of fiber-reinforced epoxy.

20. A sports racquet according to claim 1, wherein one of said frame halves is pre-molded, and wherein the other frame half is molded onto the pre-molded half.

21. A sports racquet as defined in claim 20, wherein said upper and lower frame halves are formed of fiber-reinforced epoxy.

22. A sports racquet as defined in claim 1, wherein said upper and lower frame halves are formed of fiber-reinforced epoxy.

23. A method of forming a sports racquet comprising the steps of:

(a) molding a first frame half having at least a tubular head portion with a first wall with planar wall surfaces along said head portion;

(b) molding a second frame half having at least a tubular head portion with a second wall with planar wall surfaces located so as to oppose the planar wall surfaces of the first frame half;

(c) bonding the planar wall surfaces together to form a racquet frame with a head portion for supporting a generally planar string bed, wherein the first and second walls form internal frame ribs which are oriented at least generally parallel to the string bed plane and extend continuously around said head portion.

24. A method according to claim 23, comprising molding each frame half so as to have a plurality of channel portions defining a portion of a string hole and mating with the channels of the other frame half to form complete string holes when the racquet halves are bonded.

25. A method according to claim 24, comprising further the step of molding the racquet halves with a peel ply of woven synthetic material over the planar wall surfaces.

26. A method according to claim 25, wherein the first and second mold halves are molded from uncured fiber-reinforced epoxy.

27. A method according to claim 23, wherein the step of bonding the planar wall surfaces together is done using a B-stage epoxy film adhesive sheet so as to maintain a predetermined spacing between the planar wall surfaces.

28. A method according to claim 27, wherein the first and second mold halves are molded from uncured fiber-reinforced epoxy.

29. A method according to claim 23, wherein the first and second mold halves are molded from uncured fiber-reinforced epoxy.

* * * * *